United States Patent [19]

Bergthaller et al.

[11] 4,323,646

[45] Apr. 6, 1982

[54] PROCESS FOR HARDENING A PHOTOGRAPHIC MATERIAL

[75] Inventors: Peter Bergthaller, Cologne; Wolfgang Himmelmann; Johannes Sobel, both of Leverkusen, all of Fed. Rep. of Germany

[73] Assignee: AGFA-Gevaert Aktiengesellschaft, Leverkusen, Fed. Rep. of Germany

[21] Appl. No.: 201,242

[22] Filed: Oct. 27, 1980

[30] Foreign Application Priority Data

Oct. 30, 1979 [DE] Fed. Rep. of Germany ..... 2943807

[51] Int. Cl.[3] ..... G03C 1/30

[52] U.S. Cl. ..... 430/622; 430/626; 430/502; 430/503; 260/117; 260/112 R; 106/125

[58] Field of Search ..... 430/621–626, 430/502, 503; 260/117, 112; 106/125

[56] References Cited

U.S. PATENT DOCUMENTS

| | | | |
|---|---|---|---|
| 2,994,611 | 8/1961 | Heyna et al. | 430/622 |
| 3,615,622 | 10/1971 | Nishio et al. | 260/117 |
| 3,689,274 | 9/1972 | Sobel et al. | 430/622 |
| 3,762,926 | 10/1973 | Himmelmann et al. | 260/117 |
| 4,088,495 | 5/1978 | Habu et al. | 260/117 |
| 4,142,897 | 3/1979 | Habu et al. | 430/622 |
| 4,161,407 | 7/1979 | Campbell | 430/622 |

*Primary Examiner*—Won H. Louie, Jr.
*Attorney, Agent, or Firm*—Connolly and Hutz

[57] ABSTRACT

A photographic material containing protein as binding agent is hardened with a compound which contains at least two free vinyl sulfonyl groups in the molecule and which is a bisulfite addition product of a compound containing up to 6 vinyl sulfonyl groups.

14 Claims, No Drawings

PROCESS FOR HARDENING A PHOTOGRAPHIC MATERIAL

This invention relates to a process for hardening a photographic material or photographic layers containing proteins, in particular gelatin, as binder and to a photosensitive photographic silver halide material hardened by this process.

Numerous substances have already been described as hardeners for proteins and, in particular, for gelatin. They include, for example, metal salts, such as chromium, aluminium or zirconium salts, aldehydes and halogen-containing aldehyde compounds, particularly formaldehyde, dialdehydes and mucochloric acid, 1,2- and 1,4-diketones, such as cyclohexane-1,2-dione, quinones and chlorides of dibasic organic acids, the anhydrides of tetracarboxylic acids, compounds containing several reactive vinyl groups, such as vinyl sulfones, acrylamides, compounds containing at least two readily cleavable, heterocyclic 3-membered rings, such as ethylene oxide and ethylene imine, polyfunctional methane sulfonic acid esters and bis-α-chloroacyl amido compounds.

High molecular weight hardeners, such as for example polyacrolein and its derivatives or copolymers and alginic acid derivatives, have recently become known, specifically being used as hardeners for photographic layer.

However, the use of the compounds referred to above for photographic purposes involves a number of serious disadvantages. Some of these compounds are photographically active and, for this reason, are unsuitable for hardening photographic materials, whilst other adversely affect the physical properties, for example the brittleness, of gelatin layers to such an extent that they cannot be used. Others cause discoloration or a change in the pH-value during the hardening reaction. In addition, it is particularly important in the hardening of photographic layers that hardening should reach its maximum as soon as possible after drying so that the permeability of the material to be hardened to the developer solution is not continually changed, as for example in the case of mucochloric acid or formaldehyde.

In certain cases, crosslinking agents for gelatin also have a damaging effect on the skin, as for example in the case of ethylene imine compound, so that their use is not advisable for physiological reasons.

It is also known that trichlorotriazine, hydroxy dichlorotriazine and dichloroamino triazines can be used as hardeners. The disadvantage of hardeners such as these lies in their relatively high vapour pressure, in the fact that hydrochloric acid is split off during hardening and in the physiological effect of these compounds. Water-soluble derivatives which contain carboxyl and sulfonic acid groups and which are obtained by reacting cyanuric chloride with one mole of diaminoalkyl or diaminoaryl sulfonic acid or carboxylic acid do not have these disadvantages and, for this reason, have recently been proposed as hardeners. However, they are of limited use in practice because, on account of their good solubility, they decompose on standing in aqueous solutions and, as a result, soon lose their effectiveness.

Finally, a very important requirement which any hardener for photographic gelatin-containing layers has to satisfy both in regard to production and also in regard to processing is that even the onset of the crosslinking reaction should be determinable within certain limits, for example through the choice of the drying temperature or the pH-value.

Other known hardeners for photographic gelatin layers are compounds containing two or more acrylic acid amido groups in the molecule, N,N'N''-tris-acrylyl hydrotriazine or methylene-bis-acrylamide.

Although the hardening of the compounds is good after a while, the compounds are sparingly soluble in water which can give rise to irregularities in hardening within the layer.

Particular problems arise in the increasingly used high-speed processing of photographic, particularly color photographic, materials which imposes increased demands on the mechanical properties and swelling behaviour of the materials. In addition, difficulties arise out of the need to produce increasingly thinner photographic layers. Attempts have been made to solve these problems by using various hardeners. The known hardeners have either caused new difficulties or have simply proved to be unsuitable. Hardeners such as these include the many known hardeners containing vinyl sulfone groups, of which divinyl sulfone (German Pat. No. 872,153) is one of the most well known. The use of divinyl sulfone is precluded by its toxicity.

In addition, German Pat. No. 1,100,942 discloses aromatic vinyl sulfone compounds whilst German Offenlegungsschrift No. 1,547,733 describes heterocyclic vinyl sulfone compounds containing nitrogen or oxygen as heteroatoms. Finally, German Pat. No. 1,808,685 and German Offenlegungsschrift No. 2,348,194 describe bis-vinyl sulfonyl alkyl compounds as hardeners.

The known vinyl sulfone compounds have proved to be unfavourable in many respects as hardeners. They are either inadequately soluble in water and necessitate particular measures to make it possible for them to be used in photographic gelatin layers or, alternatively, they adversely affect the drying behaviour of the layers. Others of these compounds increase the viscosity of the casting composition to such an extent that the processing of the casting compositions into layers is disturbed. Another effect of hardeners of the vinyl sulfone type, particularly in colour photographic recording materials is that they cause photographic additives to migrate from one layer to the other, resulting in changes both in colour and in the photographic properties.

It is known from German Offenlegungsschrift No. 2,635,518 that gelatin can be hardened by reaction with a product obtained by reacting a compound containing at least three vinyl sulfonyl groups and a compound containing at least one water-soluble group and at least one group reacting with the vinyl sulfone group.

The disadvantage of these gelatin-hardening products lies in the fact that the formation of high molecular weight secondary products cannot be avoided in their production. The uncontrollably formed secondary products are incapable or barely capable of diffusing within a photographic layer assembly. They remain in the layer into which they were initially introduced and in which they give rise to over-hardening which is dependent upon the quantity of secondary products formed and, hence, cannot be controlled.

The object of the present invention is to provide a photographic recording material which contains a hardener having improved properties.

The present invention relates to a process for hardening a photographic material with a compound containing vinyl sulfonyl groups as a hardener which is characterised in that a bisulfite addition product, containing at least two free vinyl sulfonyl groups in the molecule, of a compound containing up to six vinyl sulfonyl groups is incorporated.

The hardeners used in accordance with the invention correspond to the following general formula $$(CH_2{=}CH{-}SO_2)_a{-}Z{-}(SO_2{-}CH_2{-}CH_2{-}SO_3{-}Me)_b$$

in which

Z represents an x-functional aliphatic hydrocarbon radical which may be substituted, an x-functional cycloalkane radical which may be substituted, such as for example a cyclohexane radical, or a hexahydrotriazine radical, or an x-functional, aromatic radical which may be substituted, such as for example a radical derived from benzene or naphthalene;

x is an integer of from 3 to 6;

a=x−b b=1 or 2 and

Me is an alkali ion or ammonium ion.

The present invention also relates to a photosensitive photographic silver halide material hardened by this process.

The hardness according to the invention contain at least two vinyl sulfonyl groups and at least one sulfone ethane sulfonic acid group in the molecule. They are soluble in water and represent excellent crosslinking agents for gelatin-containing layers.

The compounds are obtained by reacting the tris- and poly-vinyl sulfones with one mole of alkali bisulfite or, in the case of polyvinyl sulfones, with two or more moles of alkali bisulfite. The reaction is described in Liebigs Annalen 601, 81 (1956) in conjunction with monovinyl sulfones, although it may readily be applied to the above compounds.

Suitable starting compounds for producing the hardeners or crosslinkers according to the invention are compounds corresponding to the following formula $$Z'(SO_2{-}CH{=}CH_2)_x$$

in which Z' represents an x-functional aliphatic hydrocarbon radical which may be substituted, an x-functional cycloalkane radical which may be substituted or an x-functional aromatic radical which may be substituted and x is an integer of from 3 to 6.

The following compounds are mentioned as examples of hardeners according to the invention:

1. $C(CH_2SO_2CH{=}CH_2)_3$
$CH_2{-}SO_2{-}CH_2{-}CH_2{-}SO_3^{\ominus}Na^{\oplus}$ 2. $C(CH_2OCH_2SO_2CH{=}CH_2)_3$
$CH_2{-}OCH_2{-}SO_2{-}CH_2{-}CH_2{-}SO_3^{\ominus}Na^{\oplus}$ 3. $C_2H_5C(CH_2SO_2CH{=}CH_2)_2$
$CH_2{-}SO_2{-}CH_2{-}CH_2{-}SO_3^{\ominus}Na^{\oplus}$ 4. $CH_3C(CH_2OCH_2SO_2CH{=}CH_2)_2$
$CH_2{-}OCH_2{-}SO_2{-}CH_2{-}CH_2{-}SO_3^{\ominus}Na^{\oplus}$ 5. $C_8H_{17}C(CH_2SO_2CH{=}CH_2)_2$
$CH_2{-}SO_2{-}CH_2{-}CH_2{-}SO_3^{\ominus}Na^{\oplus}$ 6. $(CH_2{=}CHSO_2CH_2)_2CHCH(CH_2SO_2CH{=}CH_2)$
$CH_2{-}SO_2{-}CH_2{-}CH_2{-}SO_3^{\ominus}Na^{\oplus}$ 7. $(CH_2{=}CHSO_2CH_2)_3CCH_2OCH_2C(CH_2SO_2CH{=}CH_2)_2$
$CH_2{-}SO_2{-}CH_2{-}CH_2{-}SO_3^{\ominus}Na^{\oplus}$ 8. $(CH_2{=}CHSO_2CH_2)_3CCH_2SO_2CH_2CH_2{-}SO_3^{\ominus}Na^{\oplus}$ 9. $(CH_2{=}CHSO_2CH_2)_2CCH_2Br$
$CH_2{-}SO_2{-}CH_2{-}CH_2{-}SO_3^{\ominus}Na^{\oplus}$ 10. $N(CH_2CH_2OCH_2SO_2CH{=}CH_2)_2$
$CH_2{-}CH_2{-}O{-}CH_2{-}SO_2{-}CH_2{-}CH_2{-}SO_3^{\ominus}K^{\oplus}$ 11. $CH_2{=}CHSO_2CH_2CHCH_2SO_2CH_2{-}CH_2{-}SO_3^{\ominus}Na^{\oplus}$
$SO_2CH{=}CH_2$ 12.
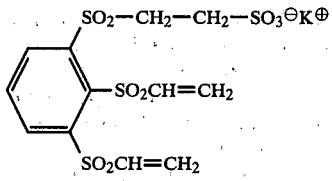

13.
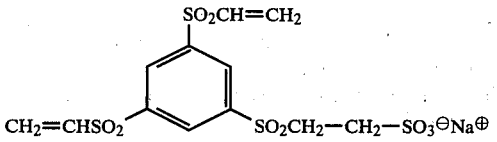

14.
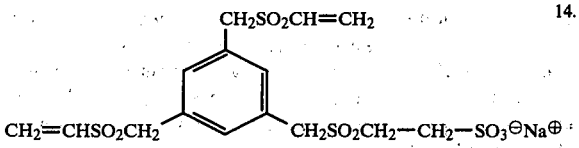

15.
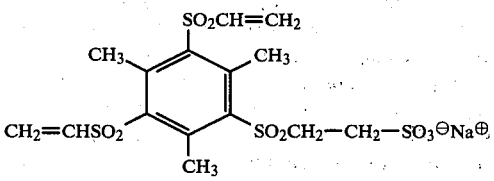

16.
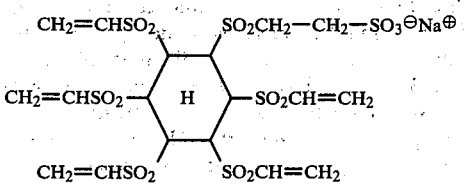

17.
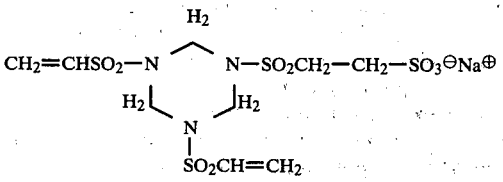

18.
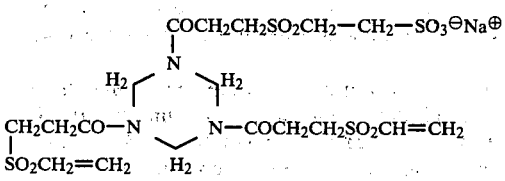

$(CH_2{=}CH{-}SO_2{-}CH_2)_2C(CH_2{-}SO_2{-}C_2H_4{-}SO_3^{\ominus}Na^{\oplus})_2$ -continued

19.

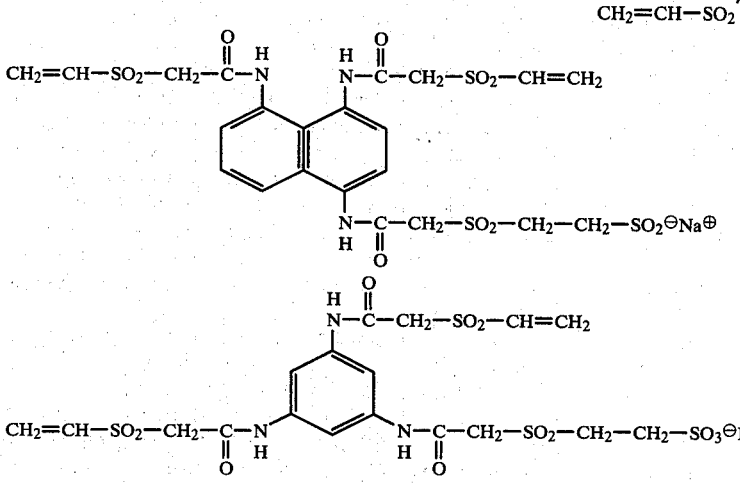

20.

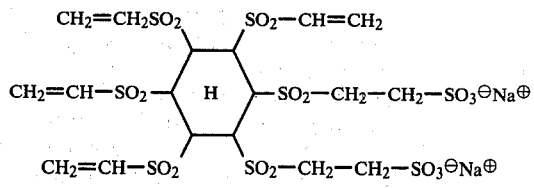

20.

21.

The molar ratio between the vinyl sulfone compounds and bisulfite may vary depending upon the number of vinyl sulfonyl groups in the starting compound, the vinyl sulfone compound. The only essential requirement is that at least two vinyl sulfone groups in the reaction product should remain in their original form because it is only in this way that a crosslinking reaction is possible with the remaining groups of the gelatin.

The process for producing the hardeners according to the invention is described in the following with reference to the production of compounds 2, 3 and 19. All of the other compounds may be similarly produced.

COMPOUND 1

The addition of $NaHSO_3$ to the compound $C(CH_2{-}SO_2{-}CH{=}CH_2)_4$ in a molar ratio of 1:1 gave the following compound

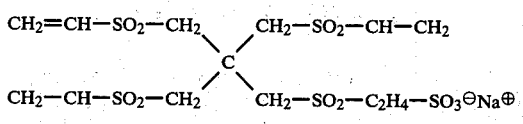

A solution of 0.025 mole (=2.6 g) of $NaHSO_3$ (40% aqueous solution) was added dropwise at 40° C. to a solution of 10.8 g (0.025 mole) of the compound $C(CH_2{-}SO_2{-}CH{=}CH_2)_4$ in 300 ml of methyl glycol. After standing for 12 hours at room temperature, the combined solutions were concentrated by evaporation in a water jet vacuum and the residue was taken up in 200 ml of acetone-water 2:1.

COMPOUND 19

The addition of $NaHSO_3$ to the compound $C(CH_2{-}SO_2{-}CH{=}CH_2)_4$ in a molar ratio of 2:1 gave the following compound

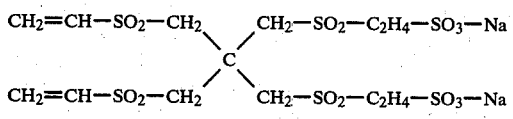

The procedure was as described above, except that 0.05 mole of $NaHSO_3$ were added. The product was taken up in 200 ml of acetone-water 1:1.

COMPOUND 3

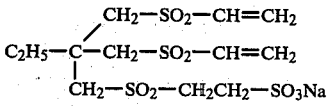

5.2 g (0.05 mole) of $NaHSO_3$ in the form of a 40% aqueous solution (13 g) were added dropwise to 40° C. to a solution of 17.8 g (0.05 mole) of the following compound

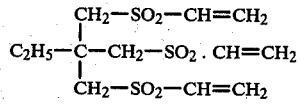

in 300 ml of methyl glycol. After 12 hours at room temperature, the combined solutions were concentrated in a water jet vacuum at a temperature below 40° C. and the residue was taken up with water-acetone 2:1 (350 ml).

The hardeners according to the invention may be added to the casting solution through metering units either sometime before casting or immediately before casting. The compounds may also be added to an overcoating solution which is poured over the finished material after production for hardening purposes. The final layer assembly may even be drawn through a solution containing the compounds according to the invention and may thus be supplied with the requisite amount of hardener. Any known hardeners may be used for prehardening the material. Finally, in the case of multilayer assemblies, for example color films and color papers, the hardeners according to the invention may be accommodated in the overall layer assembly simply by addition to the intermediate layers. This system affords advantages because the casting solutions for intermediate layers generally contain less gelatin so that no problems attributable to changes in viscosity can arise.

The hardeners according to the invention are generally used in a quantity of from 0.01 to 15% by weight and preferably in a quantity of from 0.1 to 10% by weight, based on the dry weight of the binder in the coating solution. The timing of the addition to the coating solution is not critical, although the hardener is best added to silver halide emulsions after chemical ripening.

In the context of the invention, photographic layers are understood quite generally to be layers of the type used in photographic materials, for example photosensitive silver halide emulsion layers, protective layers, filter layers, anti-halo layers, backing layers or, quite generally, photographic auxiliary layers.

Photosensitive emulsion layers for which the hardening process according to the invention is particularly suitable are, for example, layers of the type based on non-sensitized emulsions, X-ray emulsions and other spectrally sensitized emulsions. The hardening process according to the invention may also be used effectively for hardening the gelatin layers used for the various photographic black-and-white and color processes, such as negative, positive and diffusion transfer processes or printing processes. The process according to the invention has proved to be particularly advantageous for hardening photographic layer assemblies of the type intended for carrying out color-photographic processes, for example those containing emulsion layers with color couplers or emulsion layers intended for treatment with solutions containing couplers.

The effect of the compounds used in accordance with the invention is not adversely affected by the usual photographic additives. Neither are the hardeners affected by photographically active substances such as, for example, water-soluble and emulsified water-insoluble dye components, stabilizers, sensitisers. They also have no adverse effect upon the photosensitive silver halide emulsions.

The photosensitive constituents present in the emulsion layers may be formed by any known silver halides, such as for example silver chloride, silver iodide, silver bromide, silver iodobromide, silver chlorobromide and silver chloroiodobromide. The emulsions may be chemically sensitized with noble metal compounds, for example with compounds of ruthenium, rhodium, palladium iridium, platinum, and gold, such as ammonium chloropalladate, potassium chloroplatinate, potassium chloropalladite or potassium chloroaurate. In addition, they may contain special sensitizers of, for example, sulphur compounds, tin(II)salts, polyamines or polyalkylene oxide compounds. The emulsions may also be optically sensitized with the dyes normally used for this purpose, for example with cyanine dyes, merocyanine dyes and mixed cyanine dyes.

Finally, the emulsions may contain any known couplers, for example colorless couplers or colored couplers, stabilizers such as mercury compounds, triazole compounds, azaindene compounds, benzothiazolium compounds or zinc compounds, wetting agents such as dihydroxy alkanes, agents which improve the film-forming properties, for example the water-dispersible particulate high polymers obtained in the emulsion polymerization of alkyl acrylate or alkyl methacrylate/acrylic acid or methacrylic acid copolymers, styrene/maleic acid copolymers or styrene/maleic acid anhydride semialkyl ester copolymers, coating aids such as polyethylene glycol lauryl ether and other standard photographic auxiliaries.

It is remarkable that the hardeners according to the invention do not produce any color changes in colour photographic materials containing couplers, such as for example magenta couplers of the 5-pyrazolone type, cyan couplers of the naphthol or phenol type and yellow couplers of the open-chain ketomethylene type, so-called 2-equivalent and 4-equivalent couplers which are derived from the above-mentioned couplers, and so-called masking couplers containing an aryl azo group at the active site.

The hardeners according to the invention are distinguished from the known hardeners of the vinyl sulfonyl type by the fact that their hardening effect is not immediate, nor do they produce so-called over-hardening of the photographic layer treated with them, which is an advantage for both the production process and the storage of photographic materials.

The crosslinking of the photographic material is determined by means of the melting point of the layers which may be determined as follows:

The layer assembly cast onto a support is semi-immersed in water heated continuously to 100° C. The temperature at which the layer separation from the substrate (streak formation) is termed the melting point. In no case do unhardened protein layers show an increase in melting point in this measuring process. Under these conditions, the melting point is in the range from 30° to 35° C.

To determine water uptake, the test specimen is developed as a black sheet in a standard color developing process and, after the final bath, is weighed after the surplus water has been stripped off. The test specimen is then dried and re-weighed. The difference, converted to 1 square meter from the surface are of the test specimen, represents the water uptake per square meter.

Swelling is gravimetrically measured after a test strip has been treated for 10 minutes in distilled water at 22° C. It is characterised by the swelling factor:

$$\frac{\text{Layer weight wet}}{\text{Layer weight dry}} = \text{swelling factor}$$

To determine wet scratch resistance, a metal point of defined size is moved over the wet layer and subjected to an increasing load. The wet scratch resistance is represented by the load under which the point leaves a visible trace on the layer. A high load corresponds to a high wet scratch resistance.

EXAMPLE 1

Quantities of 1 and 2 g of the compounds according to the invention, based on gelatin, are added in the form of an aqueous solution at pH 6.2 to 100 ml of a photographic silver bromide gelatin emulsion ready for casting (gelatin content 10% by weight). The mixture is thoroughly stirred and immediately cast onto a prepared cellulose triacetate support using a standard casting machine, and dried.

The material is stored under various climatic conditions, after which crosslinking is tested by determining the layer melting point, the wet scratch resistance and the swelling factor. Good crosslinking is reflected in a high layer melting point, a high wet scratch resistance and a low swelling factor.

The results are set out in the following Table.

TABLE 1

| Hardener | Storage for 36 hours at 57° C./34% relative humidity: Layer melting point | swelling factor | wet scratch resistance (P) |
|---|---|---|---|
| Compound 1 | | | |
| 1 g | 100° C. | 4.8 | 250 |
| 2 g | 100° C. | 4.0 | 550 |
| Compound 3 | | | |
| 1 g | 100° C. | 6.5 | 150 |
| 2 g | 100° C. | 5.7 | 200 |
| Compound 19 | | | |
| 1 g | 100° C. | 5.1 | 200 |
| 2 g | 100° C. | 4.1 | 350 |
| Compound 17 | | | |
| 1 g | 100° C. | 5.7 | 200 |
| 2 g | 100° C. | 5.3 | 350 |
| Compound 12 | | | |
| 1 g | 100° C. | 5.5 | 200 |
| 2 g | 100° C. | 5.1 | 250 |
| Comparison | 38° C. | >7 | <150 |

| Hardener | Storage for 7 days at 36° C./80% relative humidity: Layer melting point | swelling factor | wet scratch resistance |
|---|---|---|---|
| Compound 1 | | | |
| 1 g | 100° C. | 3.1 | 650 |
| 2 g | 100° C. | 2.7 | 800 |
| Compound 3 | | | |
| 1 g | 100° C. | 5.3 | 200 |
| 2 g | 100° C. | 4.1 | 450 |
| Compound 19 | | | |
| 1 g | 100° C. | 3.8 | 450 |
| 2 g | 100° C. | 3.1 | 600 |
| Compound 17 | | | |
| 1 g | 100° C. | 3.6 | 500 |
| 2 g | 100° C. | 2.9 | 800 |
| Compound 12 | | | |
| 1 g | 100° C. | 4.4 | 350 |
| 2 g | 100° C. | 3.5 | 550 |
| Comparison | 38° C. | >7 | <150 |

Table 1 shows that boiling-resistance layers (melting point 100° C.) are obtained with the addition of only 1 to 2 g of hardener per 100 g of gelatin. After storage at 36° C./80% relative air humidity, hardening shows a moderate increase, no overhardening being obtained. The casting solutions may be left standing for one hour without any increases in viscosity, an indication of the favourable minimal crosslinking of the gelatin in the solution. After development and fixing, the layers do not show any unfavourable properties by comparison with the unhardened layer. Sensitivity, fog values and Γ values remained the same. The hardeners were inert with respect to the silver halide emulsion, even after prolonged storage of the layers.

EXAMPLE 2

A color photographic material is prepared by successively applying the following layers to a paper support lined with polyethylene and provided with an subbing layer, the emulsion layers containing the usual additions of wetting agents, stabilizers etc.:

1. As undercoat a 4μ thick-sensitive silver bromide emsulsion layer containing per kg of emulsion 25.4 g of silver (88% of AgBr, 12% of AgCl), 80 g of gelatin and 34 g of the yellow component

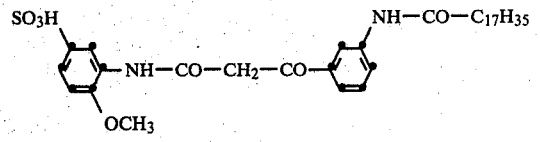

2. as intermediate layer a 1μ thick gelatin layer, 3. as middle coat a 4μ thick green-sensitive silver chloride bromide emulsion layer containing per kg of emulsion 22 g of silver (77% of AgCl, 23% of AgBr), 80 g of gelatin and 13 g of the magenta component

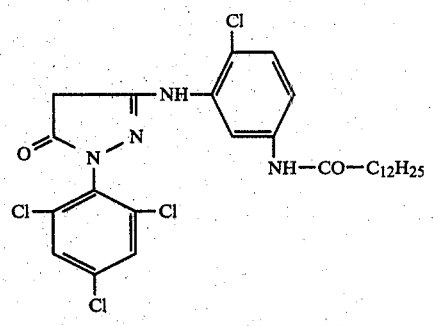

4a. 1μ thick intermediate layer as described under 2,

5. As topcoat a 4μ thick red-sensitive silver chloride bromide emulsion layer containing per kg of emulsion 23 g of silver (80% of AgCl, 20% of AgBr), 80 g of gelatin and 15.6 g of the cyan component

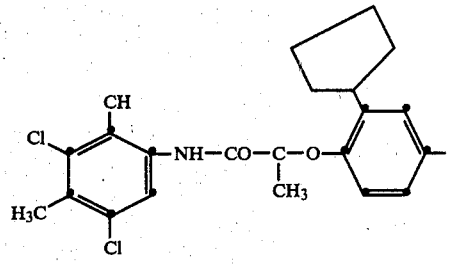

6. A 1μ thick protective layer of gelatin.

3.5 g of hardener per 100 g of gelatin are added to each casting solution, after which the layer assembly is completed (test series 1). In a second test series, the hardeners were added to the intermediate layers only in such a quantity that the layer assembly again contained 3.5 g of hardener based on 100 g of gelatin. Both series were stored under the same conditions and tested for hardening or crosslinking. The casting solutions all had pH values of 6.5.

| | After storage for 36 hours at 57° C./34% relative humidity: layer melting point | swelling factor | wet scratch resistance |
|---|---|---|---|
| Test series 1 | | | |
| 3.5 g of compound 1 | >100° C. | 4.2 | 600 |
| 3.5 g of compound 3 | >100° C. | 6.5 | 200 |
| Test series 2 | | | |
| 3.5 g of | | | |

-continued

| | After storage for 36 hours at 57° C./34% relative humidity | | |
|---|---|---|---|
| | layer melting point | swelling factor | wet scratch resistance |
| compound 1 | >100° C. | 4.0 | 650 |
| 3.5 g of compound 3 | >100° C. | 5.8 | 300 |

| | After storage for 7 days at 36° C./80% relative humidity | | |
|---|---|---|---|
| | layer melting point | swelling factor | wet scratch resistance |
| Test series 1 | | | |
| 3.5 g of compound 1 | >100° C. | 2.7 | 800 |
| 3.5 g of compound 3 | >100° C. | 3.5 | 600 |
| Test series 2 | | | |
| 3.5 g of compound 1 | >100° C. | 2.5 | 850 |
| 3.5 g of compound 3 | >100° C. | 3.1 | 650 |

The approximately identical values for the crosslinking of the layers of test series 1 and 2 show that the hardner diffuses very effectively and has a good hardening effect even in those layers into which it first has to diffuse. There is even an indication that hardening as a whole is better if the hardener is added only to the intermediate layers rather than to all of the layers. After color photographic processing in the usual processing baths, layers having comparable photographic values, such as sensitivity, fogging and gradation, were obtained. Both hardeners are inert in both forms to the photographic emulsion and to the color coupler compounds.

EXAMPLE 3

The following layers are successively applied to a cellulose triacetate support layer provided with an subbing layer:

1. An anti-halation layer containing 4 g of gelatin and 0.7 g of colloidal black silver per square meter, 2. a 6μ thick red-sensitive layer containing per square meter 35 mMoles of silver halide (95% of AgBr, 5% of AgI), 4 mMoles of a cyan coupler corresponding to the following formula

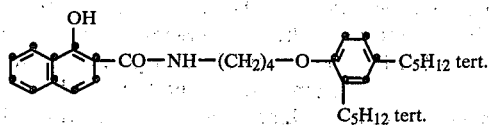

and 6 g of gelatin, 3. a 0.5μ thick gelatin intermediate layer, 4. a 6μ thick green-sensitive layer corresponding to that of Example 1 with the following compound

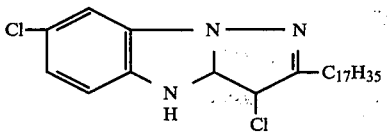

as magenta coupler, 5. a 0.5μ thick gelatin intermediate layer, 6. a yellow filter layer containing 1.5 g of gelatin and 0.2 g of colloidal yellow silver per square meter, 7. a 6μ thick blue-sensitive layer containing per square meter 13 mMoles of silver halide (95% of AgBr, 5% of AgI), 2 mMoles of a yellow coupler corresponding to the following formula

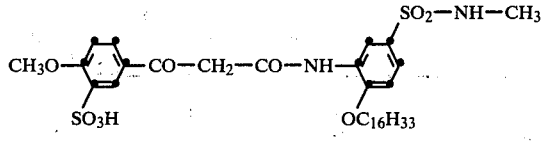

and 5 g of gelatin and 8. a 1μ thick gelatin protective layer.

The layer assembly is then dried.

After drying, the layers have a layer melting point of 38° C. and could not be processed even in baths at 20° C., on account of the high swelling and pronounced tendency towards shrivelled grain formation.

After drying, samples of the material were coated with hardener:

Hardner overcoating solution I: 0.025 mole of compound 3 to 200 cc of aqueous solution. The solution additionally contained 0.375% by weight of saponin.

Hardener overcoating solution II: 0.025 mole of compound 1 to 200 cc of aqueous solution. The solution additionally contained 0.375% by weight of saponin.

After drying and storage, the layer assembly as a whole was hardened. The following results were obtained:

| | Storage for 36 hours at 57° C./34% relative humidity | | |
|---|---|---|---|
| | melting point | swelling factor | wet scratch resistance |
| Hardener overcoating solution I | 100° C. | 4.4 | 200 |
| Hardener overcoating solution II | 100° C. | 4.5 | 250 |

| | Storage for 7 days at 36° C./80% relative humidity | | |
|---|---|---|---|
| | melting point | swelling factor | wet scratch resistance |
| Hardener overcoating solution I | 100° C. | 2.8 | 300 |
| Hardener overcoating solution II | 100° C. | 3.3 | 250 |

The results show that the hardener has diffused through, and hardened, the entire layer assembly. The photographic values, such as sensitivity and fogging, were not affected.

We claim:

1. A process for hardening a photographic silver halide material comprising of a support layer and, applied thereto, at least one gelatin-containing layer, said process comprising hardening said at least one gelatin-containing layer with a compound containing vinyl sulfonyl groups wherein the hardener is a compound containing at least two free sulfonyl groups in a molecule of a compound containing up to six vinyl sulfonyl corresponding to the following general formula $$(CH_2{=}CH{-}SO_2)_a{-}Z{-}(SO_2{-}CH_2{-}CH_2{-}SO_3\text{-}Me)_b$$

in which

Z is an x-functional aliphatic hydrocarbon radical which may be substituted, an x-functional cycloalkane radical which may be substituted or an x-functional aromatic radical which may be substituted, x is an integer of from 3 to 6, a=x−b b=1 or 2 and Me is an alkali metal or ammonium ion.

2. A process as claimed in claim 1, characterised in that the following compound

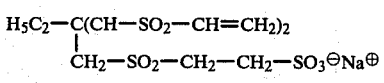

is used as hardener.

3. A process as claimed in claim 1, characterised in that the following compound

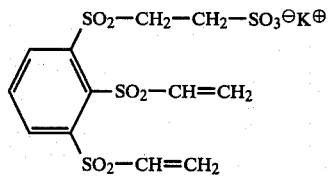

is used as hardener.

4. A process as claimed in claim 1, characterised in that the following compound

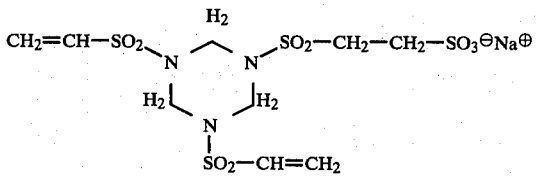

is used as hardener.

5. A process as claimed in claim 1, characterised in that the following compound

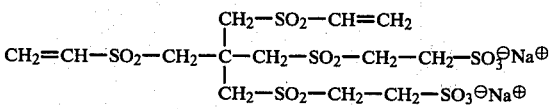

is used as hardener.

6. A process as claimed in claim 1, characterised in that the compound is incorporated in a quantity of from 0.1 to 10% by weight, based on the photographic binder to be hardened.

7. A process as claimed in claim 1, characterised in that the photographic material is color photographic multilayer material.

8. A photosensitive photographic silver halide material comprising of a support layer and, applied thereto, at least one gelatin-containing layer hardened with a compound containing vinyl sulfonyl groups, characterised in that the hardening compound is a bisulfite addition product, containing at least two free vinyl sulfonyl groups in the molecule, of a compound containing up to six vinyl sulfonyl groups corresponding to the following general formula $$(CH_2{=}CH{-}SO_2)_a{-}Z{-}(SO_2{-}CH_2{-}CH_2{-}SO_3Me)_b$$

in which

Z is an x-functional aliphatic hydrocarbon radical which may be substituted, an x-functional cycloalkane radical which may be substituted or an x-functional aromatic radical which may be substituted, x is an integer of from 3 to 6, a=x−b b=1 or 2 and Me is an alkali metal or ammonium ion.

9. A photosensitive material as claimed in claim 8, characterised in that it is hardened with the following compound

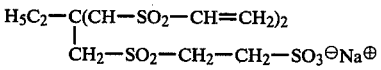

10. A photosensitive material as claimed in claim 8, characterised in that it is hardened with the following compound

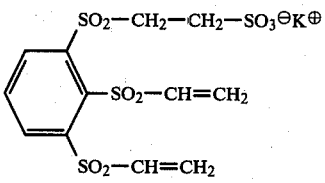

11. A photosensitive material as claimed in claim 8, characterised in that it is hardened with the following compound

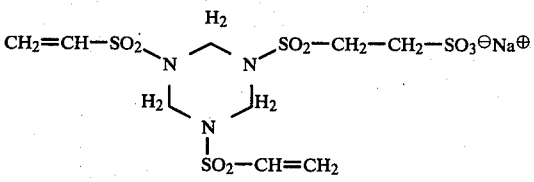

12. A photosensitive material as claimed in claim 8, characterised in that it is hardened with the following compound

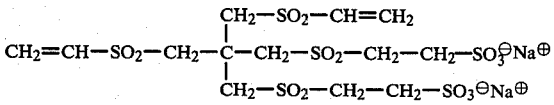

13. A photosensitive material as claimed in claims 8, 9 to 12, characterised in that it contains from 0.1 to 10% by weight of the hardening compound, based on the dry weight of the gelatin.

14. A photosensitive material as claimed in claims 8, 9 to 13, characterised in that is is a color photographic multilayer material.

* * * * *